United States Patent [19]

Uchino et al.

[11] 4,059,196

[45] Nov. 22, 1977

[54] SYSTEM FOR CONTROLLING A POWER SHOVEL

[75] Inventors: Hisanori Uchino; Masamichi Takada, both of Tokyo; Takahiro Shimizu, Kawasaki; Masamitsu Shibayama; Fumiya Furuno, both of Yokohama, all of Japan

[73] Assignee: Hokushin Electric Works, Ltd., Tokyo, Japan

[21] Appl. No.: 666,381

[22] Filed: Mar. 12, 1976

[30] Foreign Application Priority Data

Oct. 15, 1975 Japan ..... 50-123196

[51] Int. Cl.[2] ..... E02F 3/32

[52] U.S. Cl. ..... 214/138 R; 180/101; 214/1 CM; 214/762

[58] Field of Search ..... 214/138 R, 762, 147 G, 214/1 CM; 180/101, 99

[56] References Cited

U.S. PATENT DOCUMENTS

| | | | |
|---|---|---|---|
| 3,630,389 | 12/1971 | Schmidt | 214/1 CM |
| 3,637,092 | 1/1972 | George et al. | 214/1 CM |
| 3,807,343 | 4/1974 | Peebles | 180/101 |
| 3,840,132 | 10/1974 | Howells, Jr. et al. | 214/138 R |
| 3,878,652 | 4/1975 | Mosher | 214/1 CM |

FOREIGN PATENT DOCUMENTS

| | | | |
|---|---|---|---|
| 1,256,086 | 2/1961 | France | 214/762 |

*Primary Examiner*—Robert J. Spar
*Assistant Examiner*—Ross Weaver
*Attorney, Agent, or Firm*—Ladas, Parry, Von Gehr, Goldsmith & Deschamps

[57] ABSTRACT

A system for controlling a power shovel for use in civil engineering works is described. The control system comprises a manual control lever consisting of a control boom, a control arm and a control bucket which are miniature of a boom, an arm and a bucket of the power shovel, and a control circuit. The control circuit includes means for detecting the displacement of the elements of the control lever, means for detecting the displacement of the elements of the power shovel, means for comparing the displacement of the control lever with one of the power shovel. The differential signal from the circuit is applied to servo-mechanisms for following up the power shovel in accordance with the movement of the control lever. The power shovel can be controlled equally with the manual control lever.

18 Claims, 18 Drawing Figures

SYSTEM FOR CONTROLLING A POWER SHOVEL

This invention relates to a system for controlling shovels for use in civil engineering works, and more particularly to an improved control system for a hydraulic shovel-type excavator, i.e. a power shovel.

A power shovel generally consists of three main sections which are a front attachment section, an upper swivel turret section to which the front attachment is mounted and a lower chassis section. This invention particularly relates to a system for controlling such a power shovel so as to carry out various works such as digging, cutting and loading.

A power shovel of a hydraulic shovel-type excavator usually comprises a boom which can be vertically turned relative to the lower chassis section, an arm pivotally mounted to one end of the boom so as to be turned vertically, and a front attachment which may be a dipper, bucket or shovel pivotally mounted to one end of the arm so as to be turned vertically. The actuation of the boom relative to the chassis section is accomplished through a hydraulic means provided between the chassis section and the boom, the arm is actuated relative to the boom by a second hydraulic means provided between the arm and the boom, and the front attachment which may be, for example, a bucket is actuated relative to the arm by a third hydraulic means provided between the arm and the bucket.

Heretofore, at least three manual control levers for respectively controlling the first hydraulic means for actuating the boom, the second hydraulic means for actuating the arm and third hydraulic means for actuating the bucket, and at least one control lever for controlling means for turning the boom, the arm and the bucket as a unit relative to the lower chassis section have been required to control the actuation of these hydraulic means and the unit turning means.

In a small operator's cage provided in the upper swivel turret section, besides these four control levers, various gears for driving the power shovel are disposed, and a skilled operator has been required to accurately accomplish certain civil engineering works such as cutting and digging by operating these control levers.

The primary object of the present invention is to provide a novel system for controlling a power shovel by which system the control of the hydraulic means and the unit turning means can be greatly simplified and various works of the power shovel can be accomplished accurately by any operator without requiring a high technical skill.

When a digging work is carried out with a power shovel, not only the shovel but also the arm, the boom coupled to the shovel, as well as their connections are apt to be covered with mud and muddy water and to be subjected to great shocks.

Another object of the present invention, therefore, is to provide a system for controlling a power shovel, wherein sensitive electromechanical parts required for the control of the power shovel are disposed in portions which are comparatively not subjected to great shocks.

Particularly when works are carried out with a power shovel, the operator must take the utmost care about local conditions, or may give rise to an accident such as hitting workers in the scene with the shovel.

Another object of the present invention, therefore, is to provide a system for controlling a power shovel, wherein the control system is not actuated unless the operator assumes a predetermined normal posture of control in the operator seat in order to prevent such an accident.

Another object of the present invention is to provide a system for controlling a power shovel, wherein when there is a great difference in relative positions between the control lever and the power shovel, the power shovel can be operated but slowly until the relative positions become within a predetermined tolerable range.

Another object of the present invention is to provide a system for controlling a power shovel, wherein the control system is provided with safety devices for preventing any undesirable operation caused, for example, by interruption of circuits in the system.

Another object of the present invention is to provide a system for controlling a power shovel, wherein the control system is provided with a load transmission device which transmits a force corresponding to a load on the shovel to the control lever to give an operation sense or feeling to the operator whereby to let the operator know the motion of the shovel or its loaded state.

In many cases, various civil engineering works such as cutting and digging may be accomplished with a power shovel by actuating the elements of the power shovel in predetermined regular sequence. In such cases, the actuation of the elements of the power shovel may be repeated in a predetermined control pattern.

Therefore, another object of the present invention is to provide a control system of a power shovel, whereby the power shovel may be operated so as to follow a predetermined control pattern as occasions demand.

The above and further objects and novel features of the present invention will more fully appear from the following detailed description when the same is read in connection with the accompanying drawings, wherein FIG. 1 is a schematic view of a power shovel;

Figure 4:
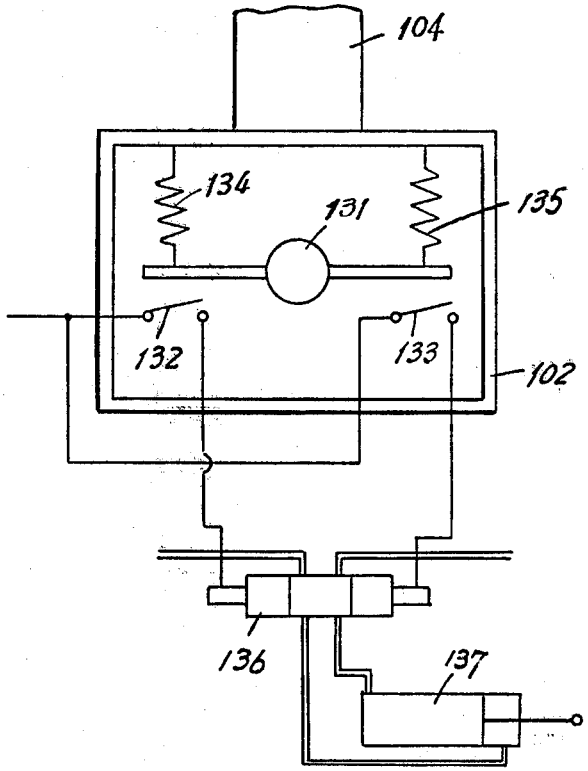
Figure 5:
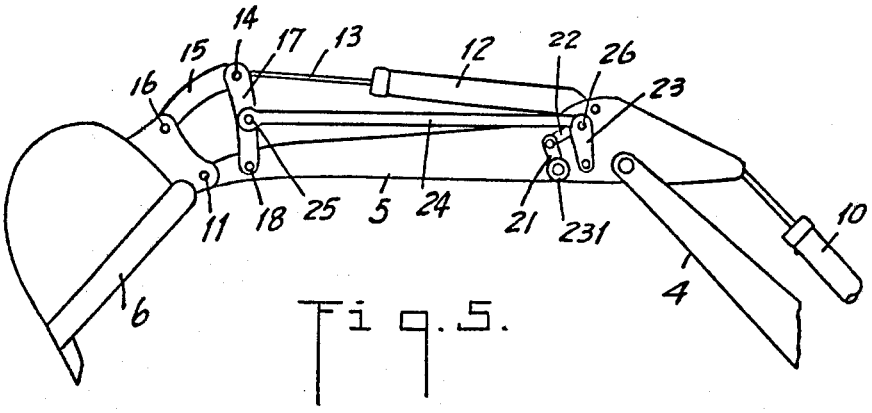
Figure 6:
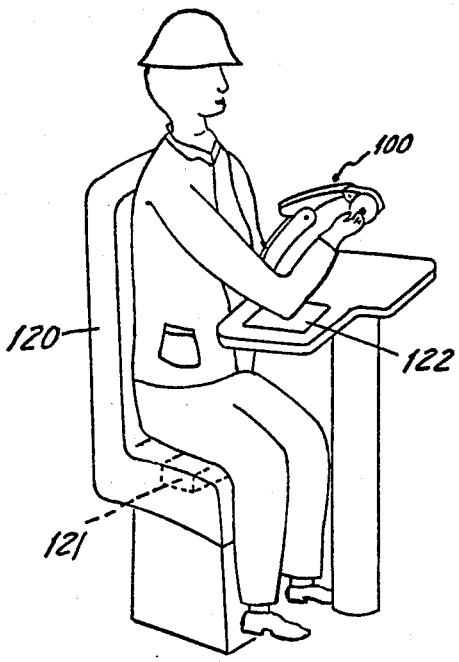
Figure 1:
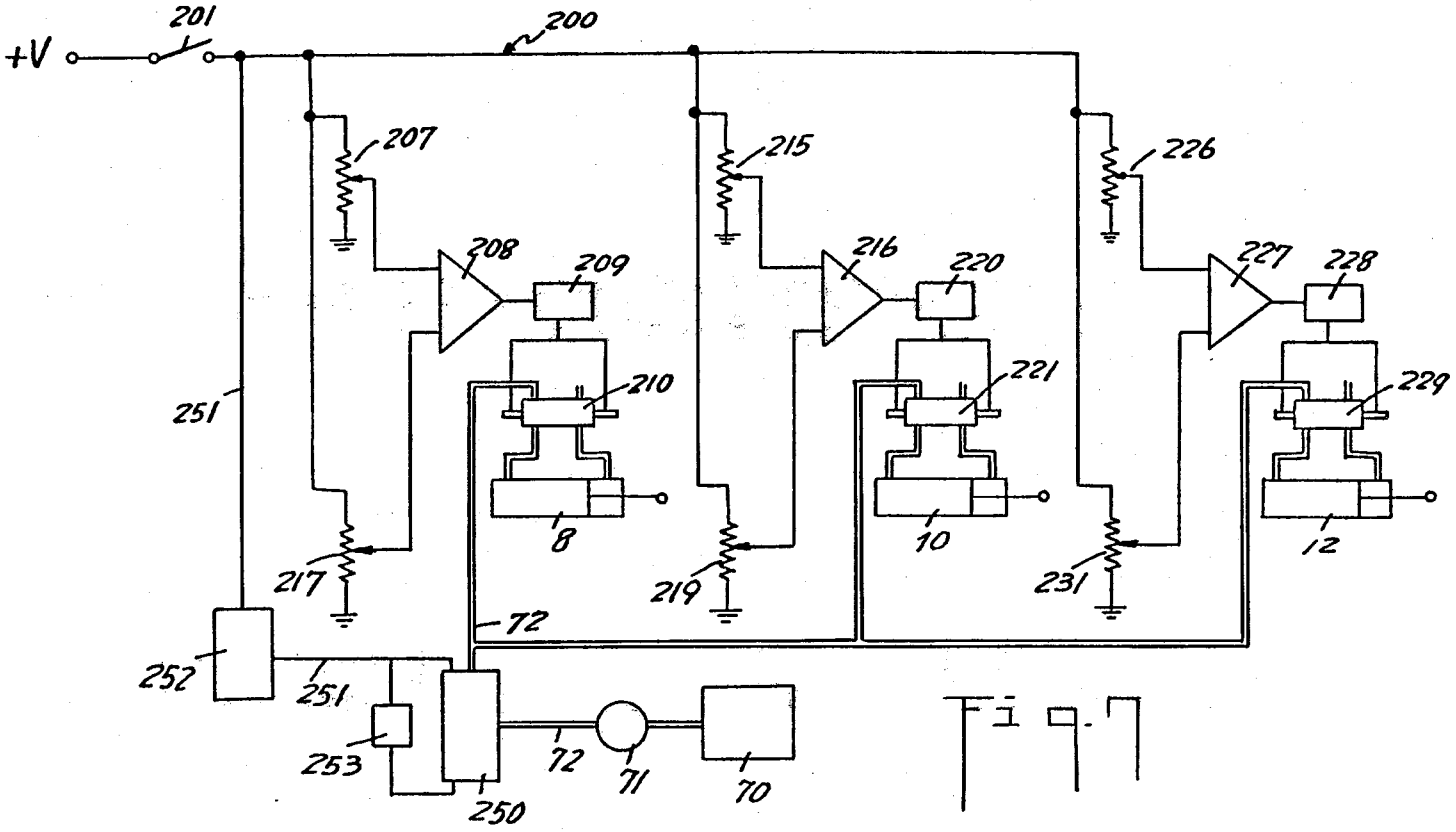
Figure 8:
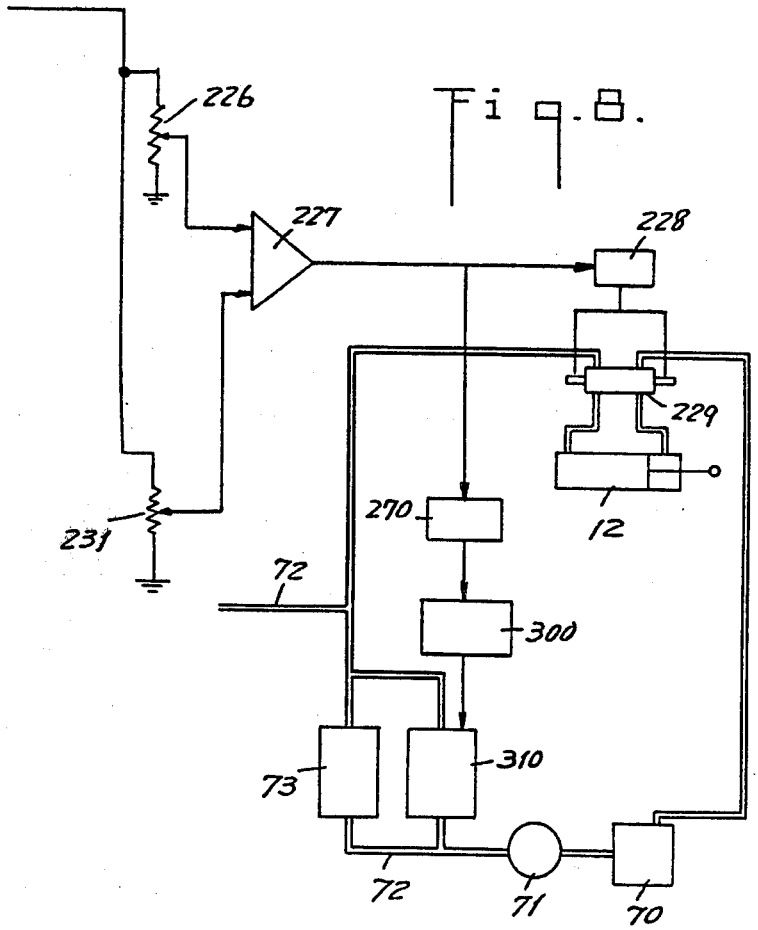
Figure 9:
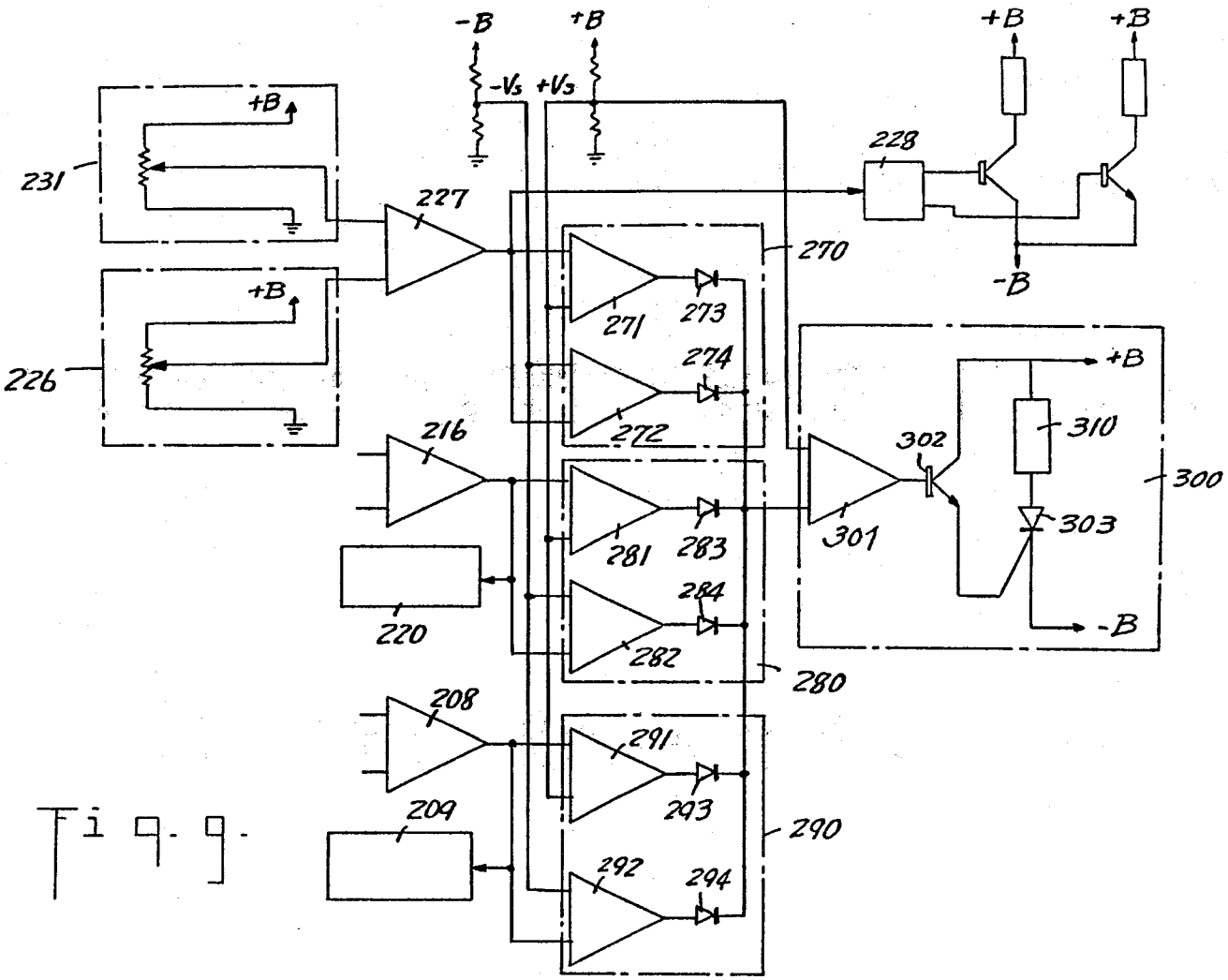
Figure 10:
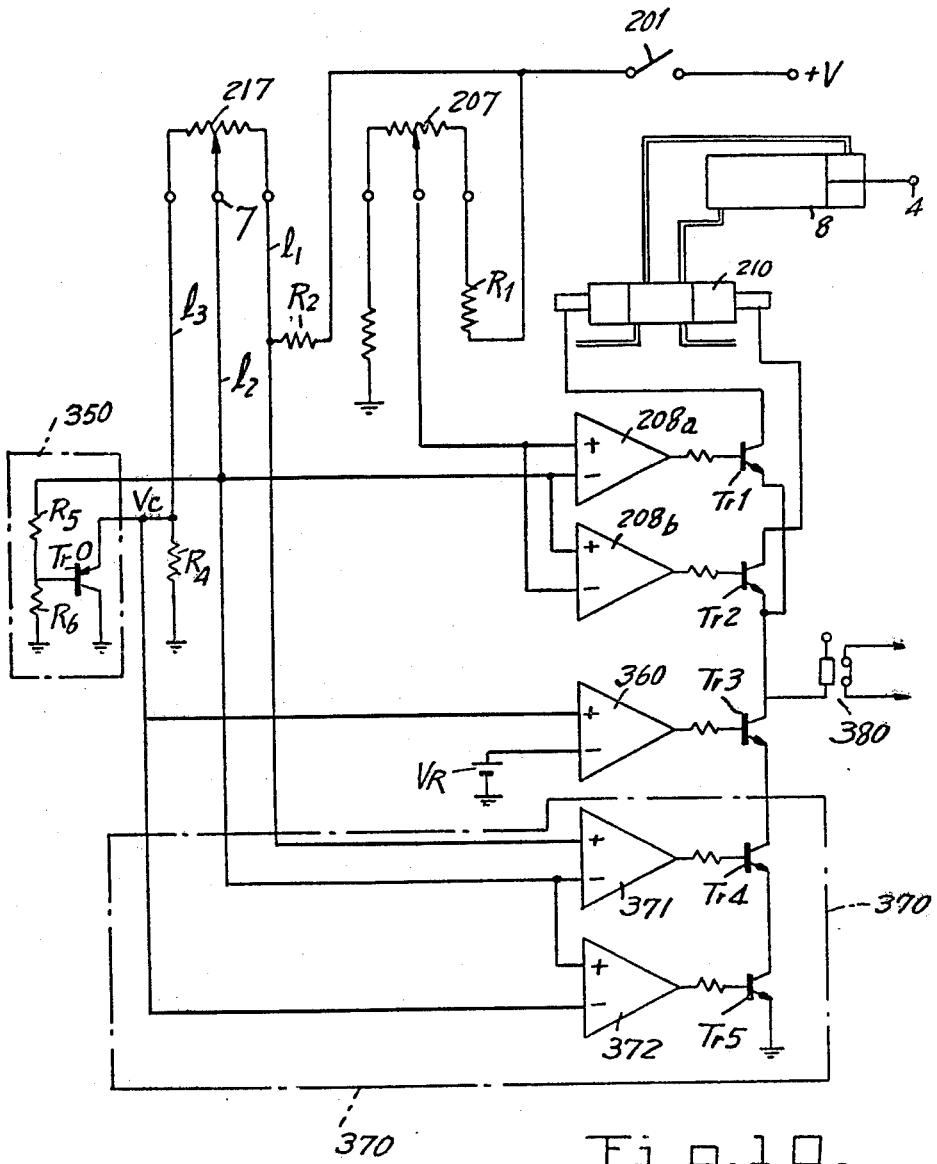
Figure 11:
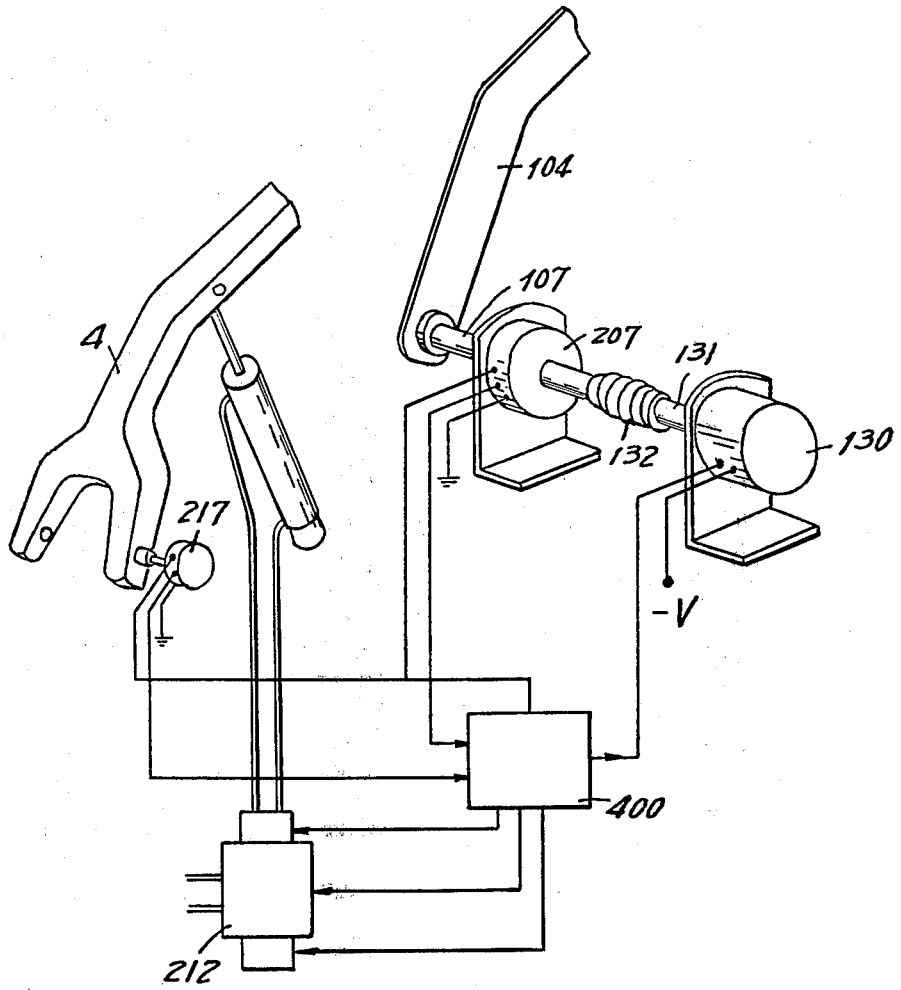
Figure 12:
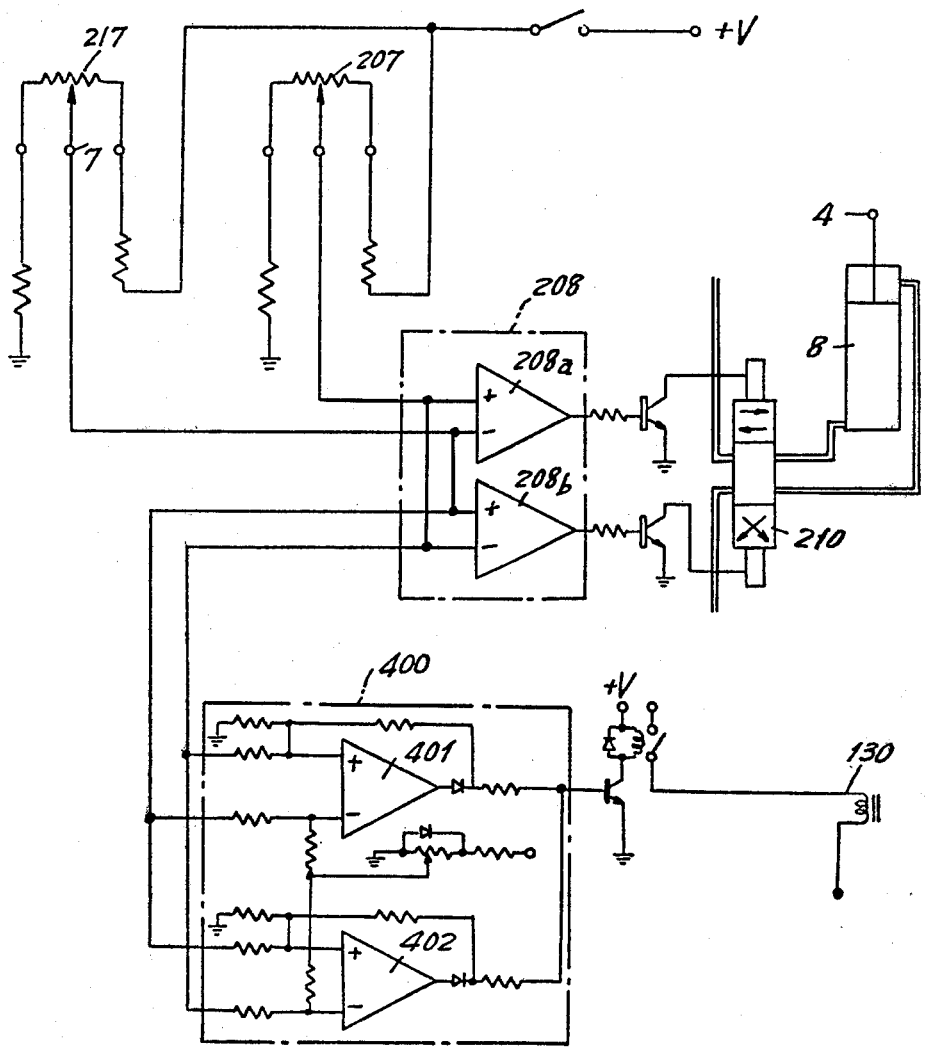
Figure 13:
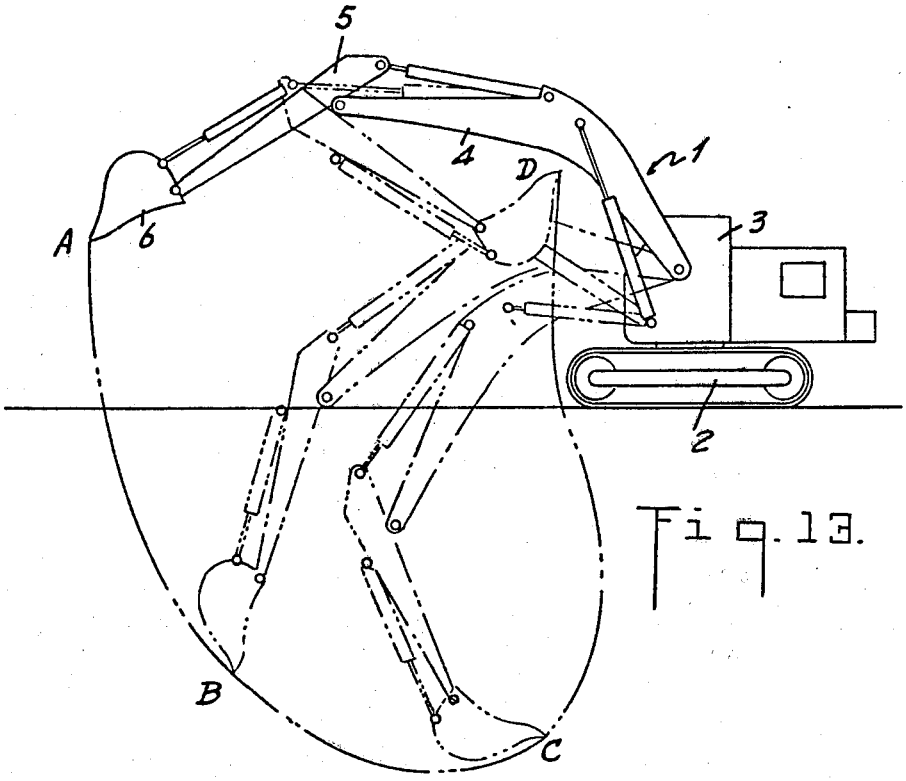
Figure 14:
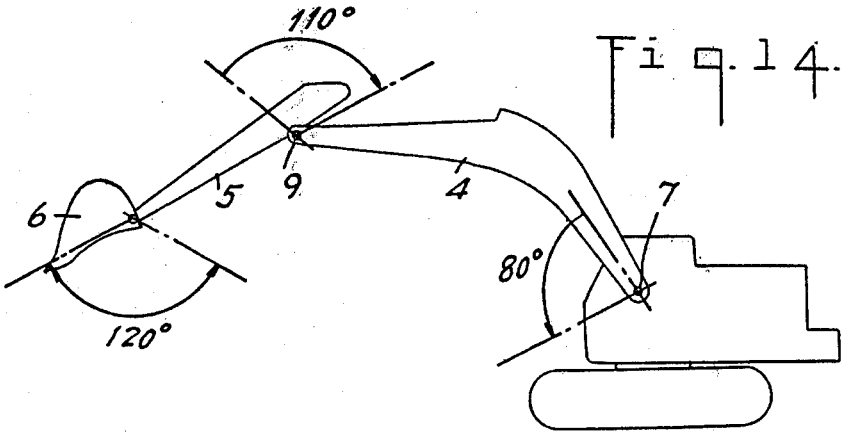
Figure 15:
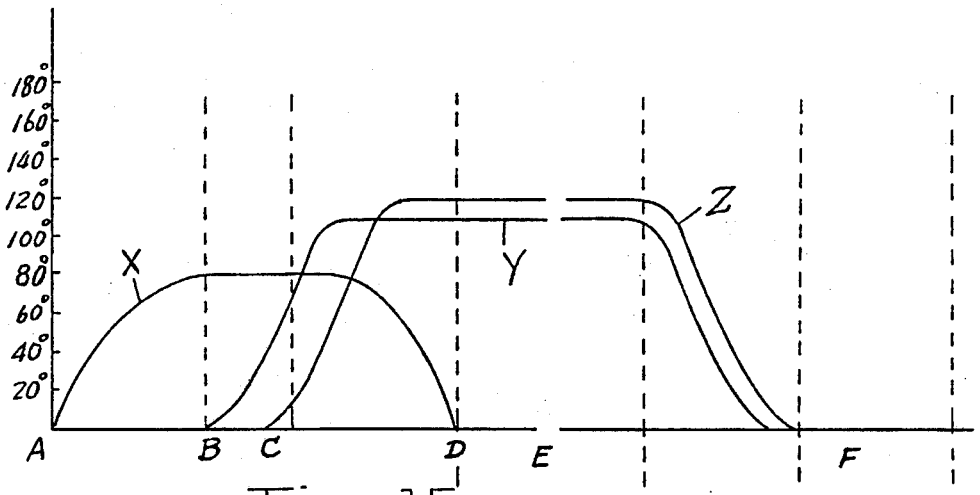
Figure 16:
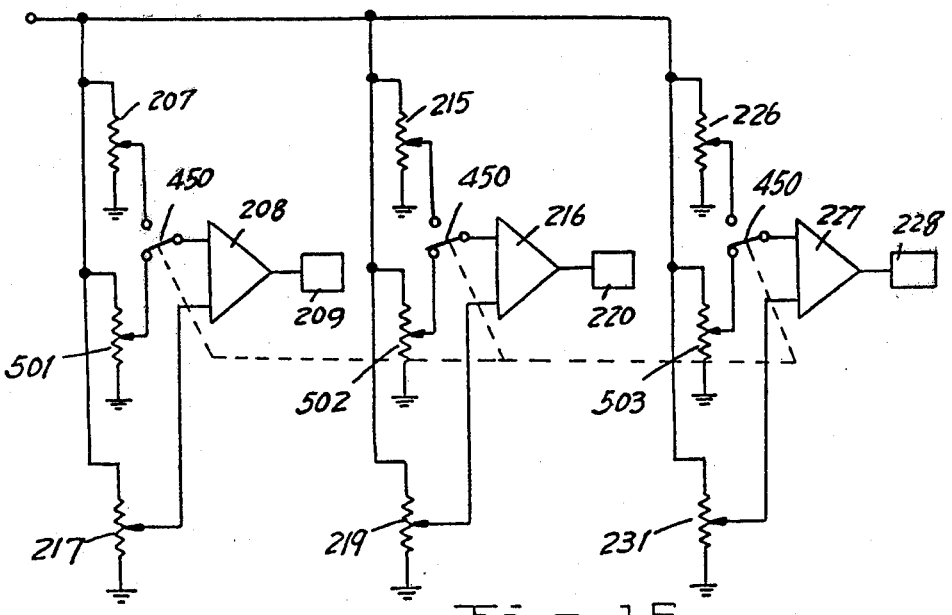
Figure 17:
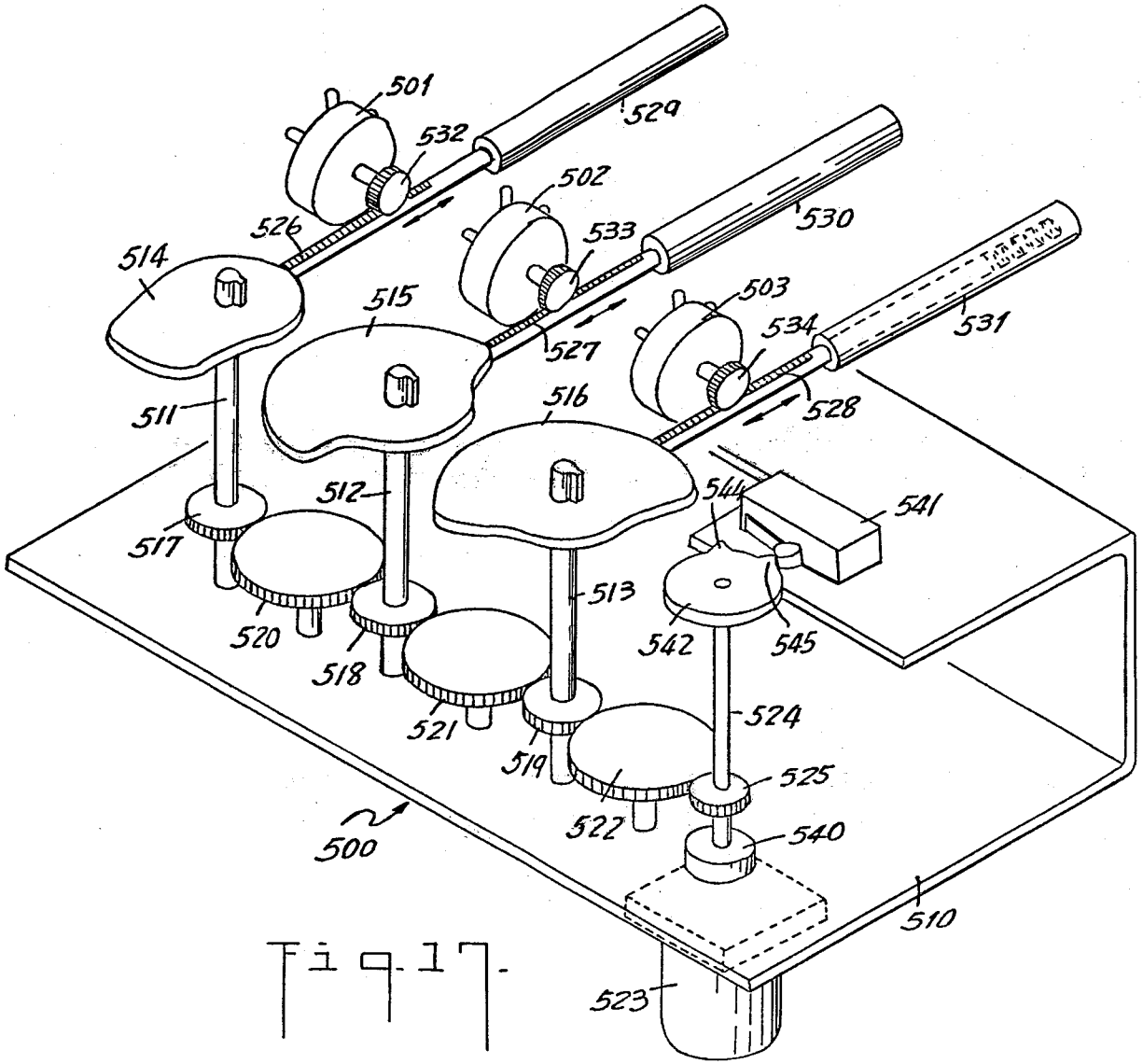
Figure 18:
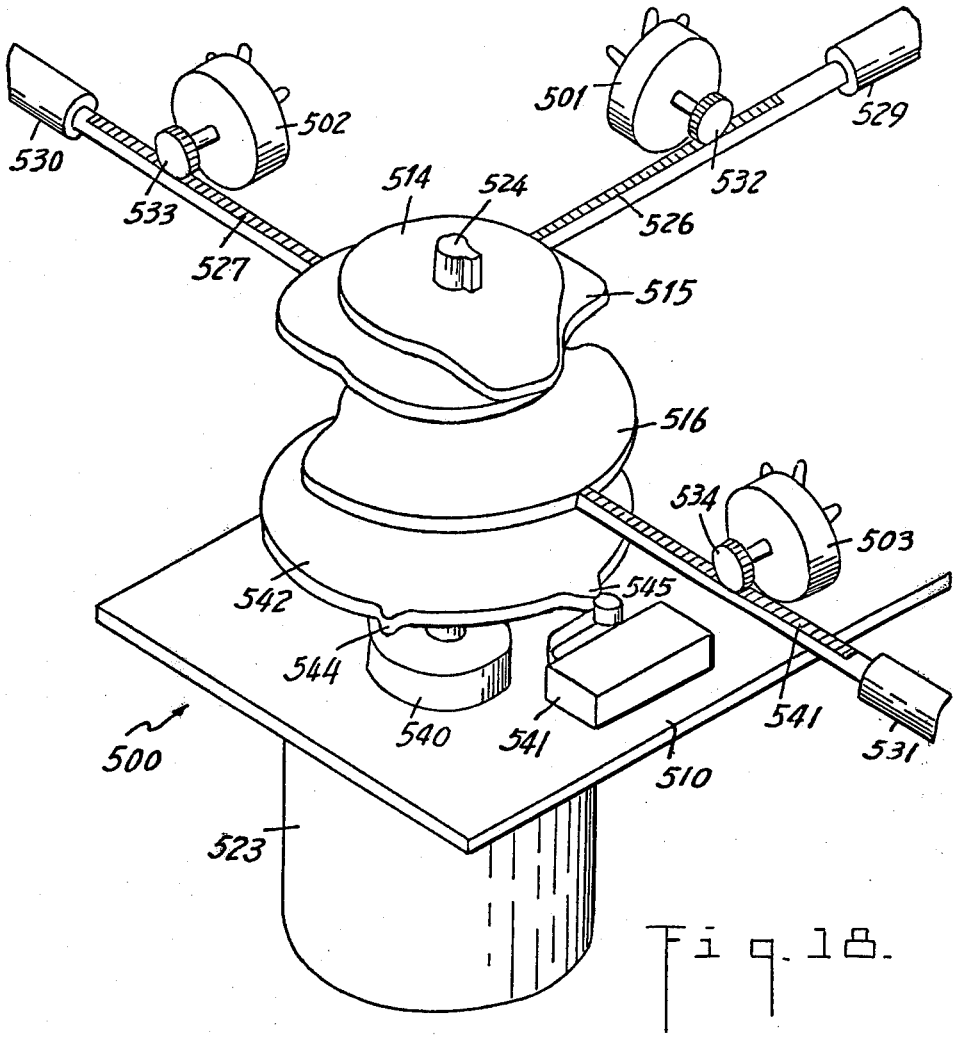

FIG. 4 schematically illustrates the horizontal control system of the present invention;

FIG. 5 is a front view of an embodiment of the present invention in which a bucket angle detector of the control system of the present invention is arranged in a position remote from the pivot of the bucket;

FIG. 6 is a schematic view showing a switch which is one of the safety devices in the control system of the present invention;

FIG. 7 is a diagram showing another safety device in an embodiment of the present invention;

FIG. 8 is a diagram to be used for describing other safety devices in an embodiment of the present invention;

FIG. 9 is a diagram showing an example of the safety devices shown in FIG. 8;

FIG. 10 is a circuit diagram of the safety devices, wherein electric leads in the power shovel control system of the present invention are interrupted;

FIG. 11 is a schematic view of an embodiment of the load transmitter in the control system of the present invention;

FIG. 12 is a circuit diagram of the load transmitter of FIG. 11;

FIG. 13 is a diagram showing a typical motion of a power shovel in digging work;

FIG. 14 is a diagram showing the turning angles of the elements of a power shovel;

FIG. 15 is a diagram showing the loci of the motion of the power shovel elements in digging work;

FIG. 16 is a circuit diagram of the control system of the present invention in which a program signal generator is associated;

FIG. 17 is a perspective view of an embodiment of the program signal generator; and FIG. 18 is a perspective view of a modification of the program signal generator.

Figure 1:
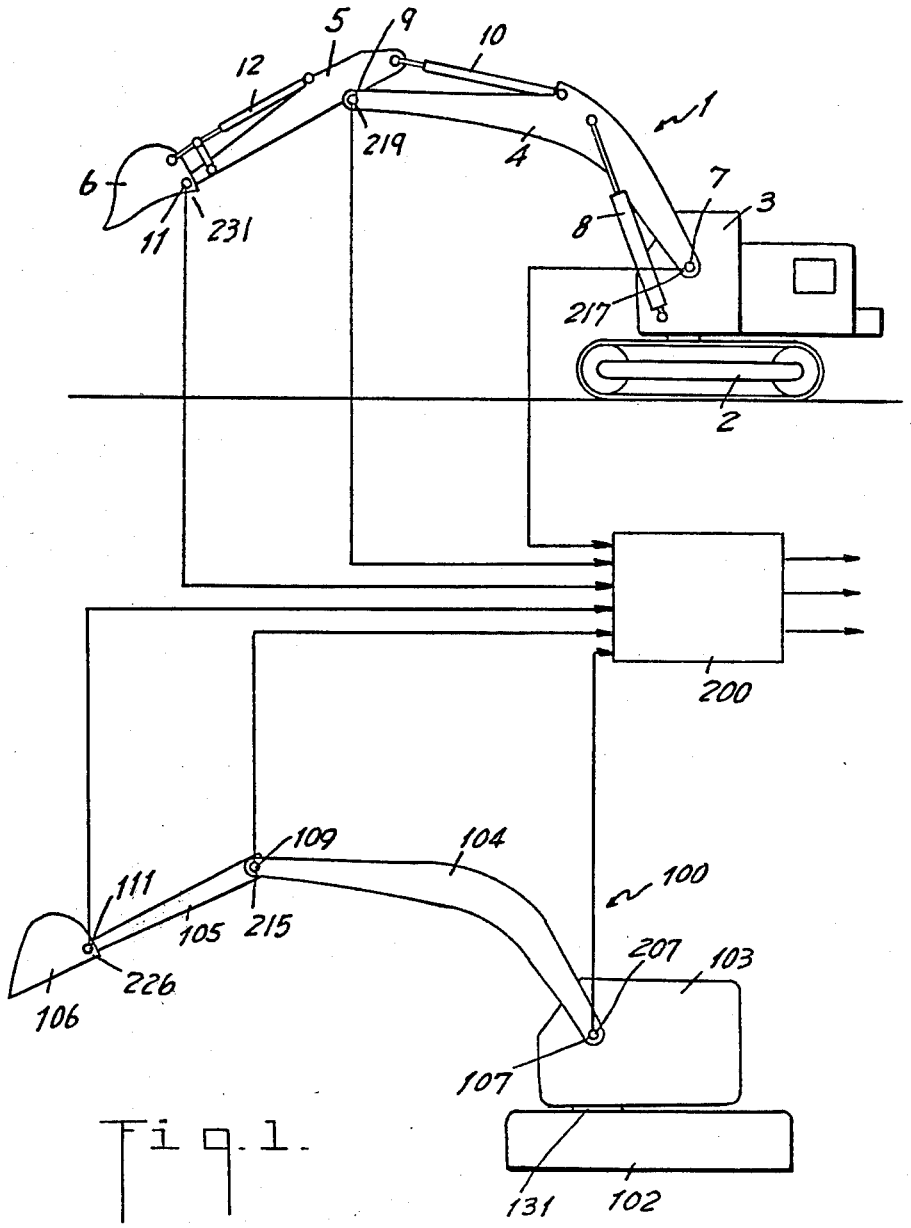

As shown in the upper section of FIG. 1, a hydraulic power shovel 1 generally consists of a lower chassis section 2, an upper swivel turret section 3 mounted on the lower chassis section, a boom 4, an arm 5 and a front attachment such as a bucket or shovel 6. The upper swivel turret section 3 generally includes an operator's cage in which control devices are disposed, and is capable of horizontally turning the boom 4, the arm 5 and the bucket 6 as a unit with the movement of the upper swivel turret section 3.

The boom 4 is pivotally mounted at one end to the upper swivel turret section 3 by means of a pivot 7 so that it may be pivoted or turned vertically by means of a hydraulic boom actuator 8.

One end of the arm 5 is pivotally mounted by means of a pivot 9 to the other end of the boom 4 so that the arm may be pivoted vertically by means of a hydraulic arm actuator 10.

The bucket 6 is pivotally mounted by means of a pin 11 to the other end of the arm 5 and it may be pivoted through a hydraulic bucket actuator 12.

According to the prior art, devices for controlling such a power shovel is disposed in the operator's cage of the swivel turret section 3 and at least four control levers, i.e. a lever for controlling the hydraulic boom actuator 8 to operate the boom 4, a lever for controlling the hydraulic arm actuator 10 to operate the arm 5, a lever for controlling the hydraulic bucket actuator 12 to operate the bucket 6, and a lever for controlling a device which horizontally turns the power shovel comprising the boom, the arm and the bucket together with the swivel turret section 3 relative to the lower chassis section 2, are required. It should be noted that these control levers are disposed in a small operator's cage.

For example, when a digging work is carried out with the power shovel 1, the operator in the cage operates the power shovel using these control levers so as to dig a desired place and to dip up mud with the bucket, then the operator turns the power shovel in a desired direction to dump the mud in the bucket, and after restoring the power shovel, the digging step is repeated.

In such a digging work, the power shovel 1, for example, in a condition as shown in FIG. 1 is operated to move the boom 4 and the arm 5 downward, then to pivot the bucket 6 downward to dig a desired place. Then the bucket 6 containing mud, the boom 4 and the arm 5 are moved upward, and thereafter the swivel turret section 3 is turned so as to move the boom, the arm and the bucket in a desired direction to dump the mud in the bucket, then the swivel turret section 3 is turned relative to the chassis section 2 to return the boom 4, the arm 5 and the bucket 6 to their original positions.

The control of the boom, the arm and the bucket as set forth hereinabove should be carried out individually and in some cases, they should be controlled jointly. Thus the manipulation of the control levers is very complicate and requires a great deal of skill.

The power shovel control system of the present invention is consisting of a combined control lever 100 and a control circuit 200. As shown in the lower section of FIG. 1, the combined control lever 100 comprises a base 102 which is a miniature of the chassis section of the power shovel in shape, a miniature swivel turret 103 mounted by a shaft 103' on the base so as to be turned horizontally relative to the base, a miniature control boom 104, a miniature control arm 105 and a miniature control bucket 106 respectively pivotally coupled to each other with pivots 107, 109 and 111. The combined control lever 100 is disposed in such as the operator's cage and others.

According to the present invention, by manually operating the elements of the combined control lever 100, reference signals corresponding to the movements of the elements are generated and the signals are transmitted to the control circuit 200 which communicates the power shovel 1 with the combined control lever 100, to provide output signals which actuate the hydraulic controllers 8, 10 and 12 in the power shovel, whereby the boom 4, the arm 5 and the bucket 6 of the power shovel are moved with the movements of the control boom 104, the control arm 105 and the control bucket 106 of the combined control lever 100.

Figure 2:
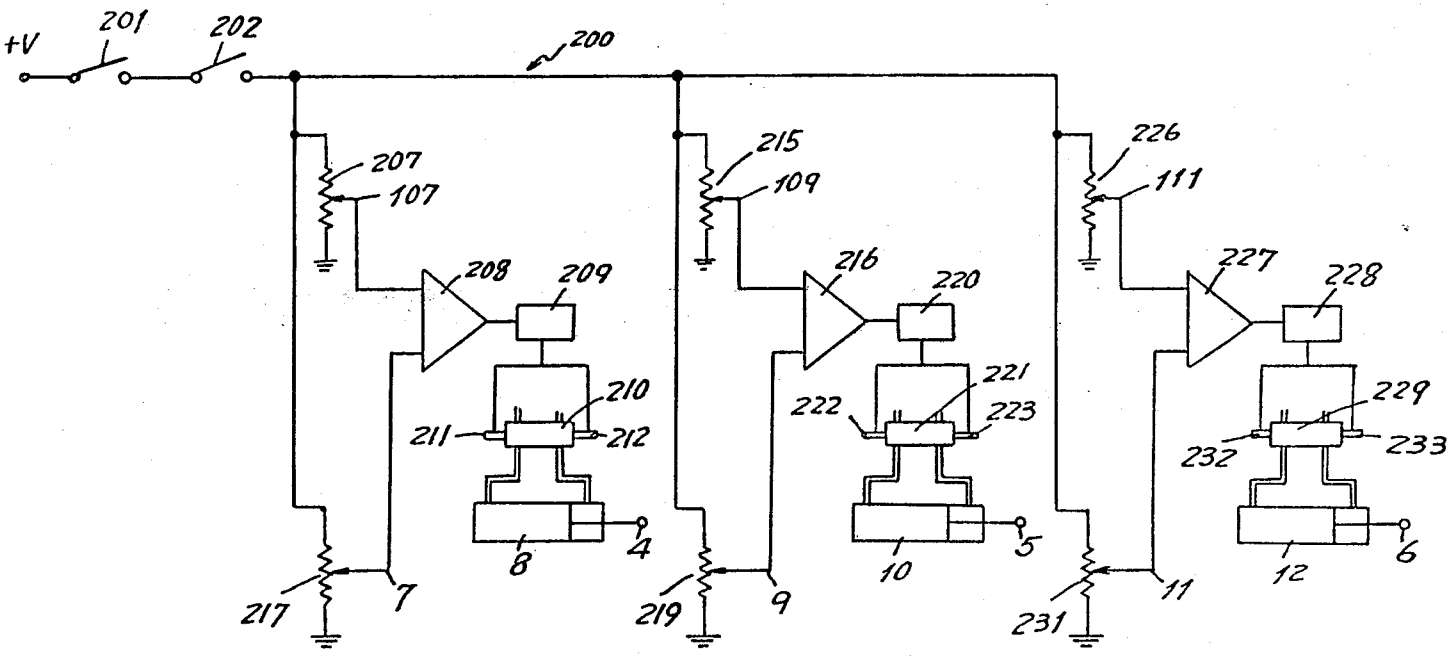
FIG. 2 is a diagram showing the relation between the electric circuits and the hydraulic controllers in an embodiment of the present invention.
Figure 3:
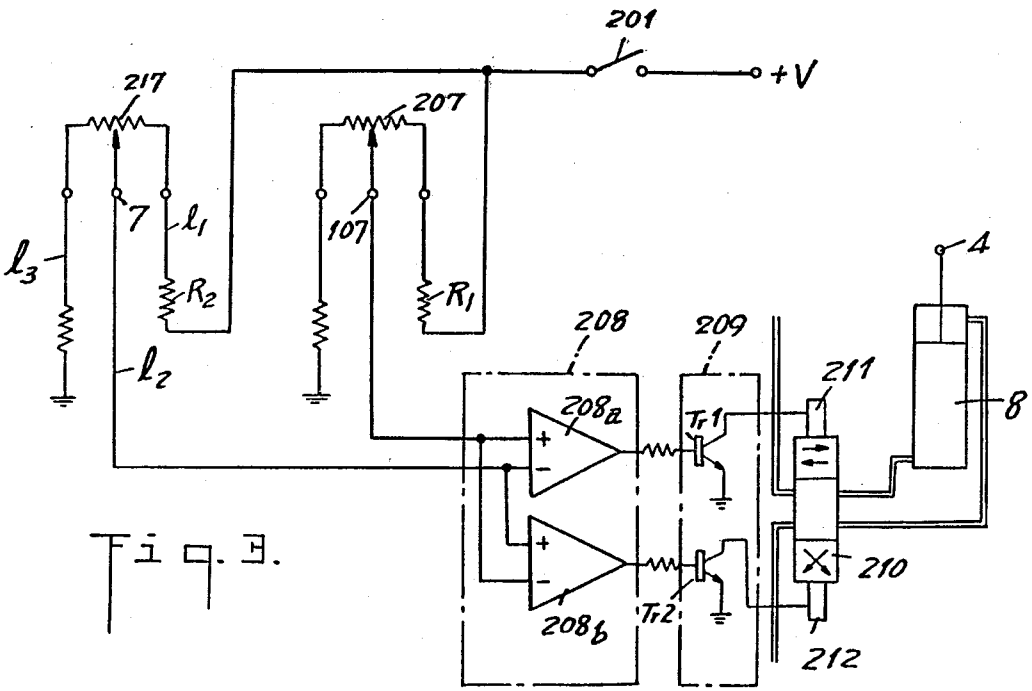
FIG. 3 is an enlarged view of a portion of FIG. 2.

FIG. 2 is a diagram showing the relation between an electric circuit and hydraulic controllers in the power shovel control system of the present invention, and FIG. 3 is an enlarged view of a portion of FIG. 2. In FIGS. 2 and 3, switches 201 and 202 serve to connect a power source +V to the circuit 200. A potentiometer 207 cooperates with the pivot 107 of the control boom 104. One end of the potentiometer 207 is connected to the power source +V through a resistor $R_1$ and when the control boom 104 is turned, a slider is turned whereby a boom angle setting signal proportional to the turn angle is applied to the non-inverse side input terminal of a comparator $208_a$ and the inverse side input terminal of a comparator $208_b$ of a comparing circuit 208. A potentiometer 217 cooperates with the pivot 7 of the boom 4 of the power shovel 1. One end of the potentiometer 217 is connected through a resistor $R_2$ to a power source +V by a lead $1_1$, and other end is grounded through a lead $1_3$. When the boom 4 is turned, a slider which cooperates with pivot 7 is turned to detect a signal proportional to the turn angle of the boom 4 and to apply the detected signal to the inverse side input terminal of the comparator $208_a$ and to the non-inverse side input terminal of the comparator $208_b$ of the comparing circuit 208.

The boom angle setting signal is compared with the detected boom turn angle signal in the comparing circuit 208 and a differential signal therebetween is applied to a driving circuit 209.

The driving circuit 209 comprises a pair of transistors $Tr_1$ and $Tr_2$ to apply an output signal to either one of exciting elements 211 and 212 of an electromagnetic valve 210 according to the sense of the differential signal received from the comparing circuit 208 to drive the hydraulic actuator 8 to turn the boom 4 whereby the motion of the hydraulic actuator 8 is controlled until the detected boom turn angle signal coincides with the value of the boom angle setting signal.

A potentiometer 215 is provided in the position of the pivot 109 of the control arm 105 so that it cooperates with the control arm 105. The potentiometer 105 is identical in construction with the potentiometer 207 of the control boom 104, thus by turning the control arm 105, the potentiometer 105 applies an arm angle setting signal to a comparing circuit 216 which is also identical with the comparing circuit 208 in construction. The comparing circuit is also fed with a detected arm turn angle signal proportional to the turn angle of the arm 5 from a potentiometer 219 to compare the signal with the arm angle setting signal and to apply a differential signal therebetween to a driving circuit 220.

The driving circuit 220 applies to output signal to either one of exciting elements 222 and 223 of an electromagnetic valve 221 according to the sense of the differential signal received from the comparing circuit 216 to drive the hydraulic actuator 10 to turn the arm 5 whereby the motion of the hydraulic actuator 10 is controlled so that the valve of the detected arm turn angle signal coincides with that of the arm angle setting signal.

In the same manner, a potentiometer 226 is provided in the position of the pivot 11 of the control bucket 106 so that it cooperates with the control bucket 106. The potentiometer 226 is identical in construction with the potentiometers 207 and 215, thus by turning the control bucket 106, the potentiometer 226 applies a bucket angle setting signal to a comparing circuit 227 which is also identical in construction with the comparing circuits 208 and 216. The comparing circuit 227 is also fed a detected bucket turn angle signal from a potentiometer 231 which cooperates with the pivot 11 of the bucket 6 of the power shovel 1. The detected bucket turn angle signal is compared with the bucket angle setting signal in the comparing circuit 227 and a differential signal therebetween is applied to a driving circuit 228. The driving circuit 228 transmits its output signal to either one of exciting elements 232 and 233 of an electromagnetic valve 229 according to the sense of the differential signal received from the comparing circuit 227 drive the hydraulic actuator 12 of the bucket 6 to turn the bucket whereby to control the motion of the actuator so that the valve of the bucket turn angle signal coincides with that of the bucket angle setting signal.

As shown in FIG. 4, the miniature swivel turret 103 is mounted by a shaft 103' to the base 102 so as to be turned horizontally the turret relative to the base 102. A pair of switch actuating bars or arms 602 and 603 is provided with the shaft 103' to actuate the corresponding electric switch means 604 and 605, which are connected to an electromagnetic valve means 608 for controlling a hydraulic actuator 611 of the upper swivel turret section 3. The actuating arms 602 and 603 are respectively connected by coil spring 606 and 607 to a frame of the base 102. When the miniature turret 103 is turned to the left or right by the operator, one of the switch means 604 and 605 is closed by means of one of arms 602 and 603 and the hydraulic actuator 611 is controlled to turn the upper swivel turret section 3 to the left or right. When the control of the operator is removed from the miniature turret 103, the miniature turret 103 will be returned back to the neutral position and turning motion of the upper swivel turret section 3 will be stopped in the place.

As described in detail hereinabove, according to the power shovel control system of the present invention, the boom 4, the arm 5 and the bucket 6 of the power shovel 1 may be turned as desired by manipulating the miniature control boom 104, the miniature control arm 105 and the miniature control bucket 106 of the combined control lever 100 held in the operator's hand.

In the power shovel control system of the present invention, the potentiometers 217, 219 and 231 which respectively detect the turn angles of the boom 4, the arm 5 and the bucket 6, are respectively disposed in the positions of the pivots 7, 9 and 11 of the boom, the arm and the bucket so that they cooperate with the pivots respectively. It should be noted, however, that in the power shovel of said type, the bucket 6 is apt to be covered with mud and muddy water and to be subjected to great shocks during the digging work. Therefore, when a potentiometer 231 for detecting the turn angle of the bucket 6 is disposed in the position of the pivot 11 between the arm 5 and the bucket 6, it should be protected from mud, muddy water as well as from shocks and it should be of a large size. However, since the space for the position of the bucket 6 is relatively limited, mounting such a large sized detector involves various difficulties.

According to the present invention, the bucket turn angle detector or the potentiometer 231 for detecting the turn angle of the bucket 6 about the pivot 11 is not necessarily disposed directly in the position of the pivot 11, but it may be disposed in any suitable position on the arm 5 so as to acculately detect the turn angle of the bucket 6.

FIG. 5 shows an example of the potentiometer 231 which serves as the bucket turn detector and which is disposed in a position remote from the bucket pivot 11. As shown in FIG. 3, the rod 13 of the hydraulic actuator 12 for the bucket is usually connected to an arm member 15 by a pin 14, and an arm member 15 is connected to the bucket 6 by a pin 16. One end of another arm member 17 is pivotally connected to the arm member 15 and the rod 13 by means of the pin 14 and the other end of the arm member 17 is pivotally connected to the arm 5 by means of a pin 18. The linkage consisting of a part of the bucket to which the pivot 11 and the pin 16 are mounted, and the arm members 15 and 17 are connected to a similar linkage (21, 22 and 23) by a connecting rod 24. One end of the connecting rod 24 is connected to the arm member 17 by a pin 25 and the other end of the connecting rod 24 is connected to the linkage (21, 22 and 23) on the bucket turn angle detector by a pin 26.

Now the operation of a preferred embodiment of the present invention will be described. In FIG. 5, when the rod 13 of the hydraulic actuator 12 is moved, i.e. extended or retreated, the movement of the rod 13 is transmitted to the bucket 6 through the linkage (17, 15, 16 – 11) whereby the bucket 6 is turned about the pivot 11. On the other hand, the movement of the arm member 17 is transmitted to the bucket turn angle detector 231 through the connecting rod 24 and the linkage (21, 22, 23) so as to rotate the shaft of the detector 231. By making the linkage (21, 22, 23) similar in relation with the linkage (17, 15, 16 – 11), the rotation of the pivot 11 of the bucket 6 may be revived at the shaft of the detector 231 so that the rotation may be detected by the potentiometer or detector 231.

FIG. 5 shows only a preferred example of the positions of the detector remote from the pivot 11 of the bucket 6, however, it is understood that the present invention is not limited to the example shown in FIG. 5 but various modifications thereof may also be applied.

As described hereinbefore, according to the present invention, the operator in the control cage can easily accomplished any desired works such as cutting and digging by manipulating the control boom 104, the control arm 105 and the control bucket 106 of the combined control lever 100 which is a miniature of the power shovel, while observing the state of the working area. It should again be noted, however, that the space in the control cage is limited and that usually many laborers are working in the area. Therefore, if the operator in the control cage touches the control lever by mistake when he approaches to or leaves from the control lever, it may result in accident because the power shovel will be moved suddenly.

The present invention provides the power shovel control system as described hereinabove, which is further provided with safety means for preventing such an accident.

FIG. 6 is a schematic view showing one of such safety means. The operator's seat 120 is provided with a switch 121 which is actuated only when the operator properly takes the seat. Another switch 122 may be provided in a suitable position of the control base 102, for example, in a position to which the operator's elbow must touch when the operator assumes the normal posture for manipulating the combined control lever 100.

Now, if the control circuit 200 is energized in the condition in which the relative positions of the elements (104, 105, 106) of the combined control lever 100 and the elements (4, 5, 6) of the power shovel 1 are not in coincidence, the boom 4, the arm 5 and the bucket 6 which are the elements of the power shovel 1, are immediately actuated and they tend to coincide with the positions of the elements of the control lever 100 respectively. Thus in such a condition, if the safety switch is pushed on to operate the power shovel 1, the power shovel will begin to move abruptly that will result in a serious accident.

According to the present invention, the power shovel control system as described hereinabove may further be provided with means for preventing the movement of the power shovel immediately after the starting switch is made on, and means for preventing such an accident as described hereinabove by slowly or intermittently moving the elements of the control lever until the relative positions of the elements of the power shovel and the control lever 100 become within a permissible range, when their relative positions are not in coincidence.

An example of the circuit to be used for this purpose will be described with reference to FIG. 7. FIG. 7 is a diagram of the control circuit 200 of the power shovel control system including a hydraulic system for the safety means. In FIG. 7, electromagnetic valve 210, 221 and 229 for respectively operating the hydraulic boom actuator 8, the hydraulic arm actuator 10 and the hydraulic bucket actuator 12 are connected to an oil tank 70 through a pump 71 and an oil pipe 72 provided with an electromagnetic valve 250. This electromagnetic valve 250 serves to close the oil pipe 72 when the switch 201 is made on so that the hydraulic boom actuator 8, the hydraulic arm actuator 10 and the hydraulic bucket actuator 12 remain unoperated. A conductor 251 connecting the switch 201 to the electromagnetic valve 250, has therein an on-delay timer 252 connected in series with the electromagnetic valve 250 and an alarm 253 connected in parallel with the electromagnetic valve 250. In this arrangement, when the switch 201 is closed, i.e. made on, the electromagnetic valve 250 closes the oil pipe 72 during the timer 252 is working. Thus during the stoppage of the power shovel, i.e. during the alarm device 253 is giving an alarm, the operator can prepare to accurately manipulate the control lever 100.

The power shovel control system of the present invention may further be provided with means for slowly operating the elements of the power shovel until they are within a permissible range by limiting the amount of oil to be fed to the hydraulic actuators of the elements, when the relative positions of the elements of the power shovel 1 and the elements of the control lever 100 are greatly disaccorded.

As shown in FIG. 8, the means for slowly operating the elements of the power shovel comprises a throttle valve 73 for limiting the amount of oil to be fed to the hydraulic actuators 8, 10 and 12, and an electromagnetic valve 310 in the line 72 and connected in parallel with the electromagnetic valve 310. When the relative positions of the power shovel elements and control lever elements are greatly disaccorded at the start, the electromagnetic valve 310 functions to bypass the pressure fluid of the oil tank 70 through the throttle valve 73 whereby to control the hydraulic actuators 8, 10 and 12. An example of the circuit for driving the electromagnetic valve 310 is shown in FIG. 9.

In FIG. 9, the potentiometer attached to the pivot 11 of the bucket 6, i.e. the bucket turn angle detector 231 is shown in a chain line block, while the potentiometer 226 attached to the pivot 111 of the control bucket 106 to take out a bucket reference signal is also shown in another chain line block. As described with reference to FIG. 2, the outputs of these potentiometers 231 and 226 are applied to the comparing circuit 227 in which they are compared. The output of the comparing circuit 227 is applied to a driving circuit 228 of the hydraulic bucket actuator 12. In this embodiment, the output of the comparator 227 is applied to a comparing circuit 270 which gives an output when the output of the comparator 227 has increased in excess of a given range. The output of the comparing circuit 270 is applied to a driving circuit 300 of an electromagnetic valve 310 which cooperates with the throttle valve 73.

As described with reference to FIG. 2, the comparator 216 compares the detected arm turn angle signal with the arm angle setting signal and gives a differential signal. The differencial signal is applied to the driving circuit 220 of the hydraulic arm actuator 10 and also to a comparing circuit 280 which gives an output when the output of the comparator 216 has exceeded a given range. The output of the comparing circuit 280 is transmitted to a driving circuit 300 of an electromagnetic valve 310, together with the output of the comparing circuit 270.

As described with reference to FIG. 2, to the input of the comparator 208, a signal proportional to the turn angle of the boom 4 and a boom angle setting signal proportional to the movement of the control boom 104 are applied. A differential signal of these signals is applied from the comparator 208 to a driving circuit 209 of the hydraulic boom actuator 8 and also to a comparing circuit 290. In the same manner of the aforementioned comparing circuits 270 and 280, the comparing circuit 290 gives an output when the output of the comparator 208 has exceeded a given range. The output of the comparing circuit 290 is applied to the driving circuit 300 of the electromagnetic valve 310 which cooperates with the throttle valve 73, together with the outputs of the comparing circuits 270 and 280.

emitter circuit of the transistor $Tr_3$ is connected in series between the common emitter circuit of transistors $Tr_1$ and $Tr_2$ for controlling the electromagnetic valve 210 and the ground.

In the foregoing arrangement, a bias of the normal sense is applied to the transistor $Tr_0$ through a resistor $R_6$. In the normal state, however, since a bias of the opposite sense introduced from the lead $1_2$ connected to the slider of the detecting potentiometer 217 is greater than the bias of the shallow order sense, the transistor $Tr_0$ remains in interrupted state. For convenience sake, the potential applied to the emitter of the transistor $Tr_0$, i.e. a lead $1_3$ is designated as Vc. The comparator 360 monitors the variation of this potential Vc and gives an output for placing the transistor $Tr_3$ in interrupted state, when the potential Vc is reduced to a value lower than the reference potential VR.

Now, the behavior of the system when the leads $1_1$, $1_2$ and $1_3$ are broken or grounded by the safety device shown in FIG. 10 will be described.

1. When the leads $1_1$, $1_2$ and $1_3$ extended to the control circuit 200 of the potentiometer 217 which is a detector for detecting the turn angle of an element of the power shovel 1, for example, the boom 4, are normal, i.e. they are neither interrupted nor grounded, a bias of the opposite sense is applied to the base of the transistor $Tr_0$ by a voltage passing through the lead $1_2$ from the terminal of the slider of the potentiometer 217 to maintain the transistor $Tr_0$ in interrupted state. The value of the voltage Vc to be applied to the abnormality detecting circuit 350 through the leads $1_3$ is designated as $Vc_1$.

2. Next, the case in which the lead $1_2$ has been broken is considered. In such a condition, an opposite sense bias is not applied to the base of the transistor $Tr_0$ but a normal sense bias current is fed thereto through the resistor $R_6$ whereby it is made conduction. Thereupon, the value of the potential Vc to be impressed to the abnormality detecting circuit 350 through the lead $1_3$ is reduced.

3. Thirdly, when the leads $1_1$ and $1_2$ of the potentiometer 217 have been broken, the current flowing through the leads $1_1$ and $1_3$ and the potentiometer 217 to the abnormality detecting circuit 350 is reduced to zero, thus the potential Vc to be applied to the abnormality detecting circuit 350 is reduced substantially to zero. The value of the potential Vc at this time is designated as $Vc_3$.

4. When the leads $1_1$, $1_2$ and $1_3$ of the potentiometer 217 is grounded, the value of the input potential Vc of the abnormality detecting circuit 350 from the power source +V is reduced substantially to zero. The value of the potential Vc at this time is designated as $Vc_4$.

Then, from the foregoing relations (1), (2) and (3), the following relation of the input potential Vc of the abnormality detecting circuit 350

$$Vc_1 > Vc_2 > Vc_3$$

comes into existence, and from the relations (1) and (4), the relation $$Vc_1 > Vc_4$$

is effected.

Thereupon, by setting the relation between the reference potential VR to be applied to the comparator 360 and the potential Vc as $$Vc_1 > VR > Vc_2 > Vc_3$$

and $$Vc_1 > VR > Vc_4$$

the output of the comparator 360 will be inverted when the leads $1_1$, $1_2$ and $1_3$ are broken or grounded, whereby the breaking or the grounding of the leads $1_1$, $1_2$ and $1_3$ may be detected.

In other words, by incorporating the abnormality detecting circuit 350 into the system of the present invention and the detecting variations in the input potential of the circuit 350 by the comparator 360, the breaking or the grounding of the leads $1_1$, $1_2$ and $1_3$ may be detected. In addition to the above, not only the breaking or the grounding of the leads but also the fault of the potentiometers for detecting the turn angles of the elements of the power shovel 1 may be detected.

Furthermore, a circuit for detecting cross contacts between the leads $1_1$, $1_2$ and $1_3$ may be associated with the safety device circuit described with reference to FIG. 10.

As shown in FIG. 10, the cross contact detecting circuit 370 comprises two comparators 371 and 372 and two transistors $Tr_4$ and $Tr_5$ to be respectively controlled by the outputs of the comparators 371 and 372.

The lead $1_1$ is connected to the non-inverse side input terminal of the comparator 371 in the cross contact detecting circuit 370, the lead $1_2$ is connected to the inverse side input terminal of the comparator 371 and to the non-inverse side input terminal of the comparator 372 while the lead $1_3$ is connected to the inverse side input terminal of the comparator 372.

The transistors $Tr_4$ and $Tr_5$ are connected in series and they are disposed between the common emitter circuit of the transistors $Tr_1$, $Tr_2$ and the ground in series to the transistor $Tr_3$.

The comparator 371 serves to the detect cross contact between the leads $1_1$ and $1_2$ and the comparator 372 detects cross contact between the leads $1_2$ and $1_3$. In the normal condition, the outputs of the comparators 371, 372 respectively control the transistors $Tr_4$ and $Tr_5$ so as to be in conductive state, and when the leads are in cross contact, the comparators control the transistor $Tr_4$ or $Tr_5$ so as to be in broken state. The working slide range of the turn angle detecting potentiometer 217 is such that all of the effective slide range is never be used and is such a range which has suitable remnant resistances at the ends respectively.

Now, the operation of the cross contact detecting circuit 370 will be described.

1. When the leads $1_1$, $1_2$ and $1_3$ are in normal condition, i.e. they are not in cross contact state, there is a potential difference between the leads. This is evident from the facts that the working slide range is not all of the effective slide range and that it has suitable remnant resistances at both ends respectively.

2. When a cross contact is taken place between the leads $1_1$ and $1_2$, the potential difference between the leads $1_1$ and $1_2$ is reduced to zero. This is detected by the comparator 371 and the transistor $Tr_4$ is interrupted.

3. When a cross contact is taken place between the leads $1_2$ and $1_3$, the potential difference therebetween is reduced to zero. This is detected by the comparator 372 and the transistor $Tr_5$ is interrupted thereby.

4. When a cross contact is taken place between the leads $1_1$ and $1_3$, the potentials of the leads $1_1$, $1_2$ and $1_3$ are equalized in level to nullify the difference therebetween. Thus the outputs of the comparators 371 and 372

The comparing circuit 270 is provided with a comparator-amplifier 271 having a non-inverse side input terminal and an inverse side input terminal. The output of the comparator 227 is applied to the non-inverse side input terminal of the comparator-amplifier and a set voltage Vs obtained by dividing the power source +B is applied to the inverse side input terminal of the comparator-amplifier 271. The comparing circuit 270 is also provided with a comparator amplifier 272 having a non-inverse side input terminal to which a set voltage −Vs obtained by dividing the power source −B is applied and an inverse side input terminal to which the output of the comparator 227 is applied. The outputs of the comparator-amplifiers 271 and 272 are transmitted respectively through rectifying diodes 273 and 274 to a driving circuit 300 of an electromagnetic valve 310 which cooperates with the throttle valve 73.

By constructing the comparing circuit 270 as described hereinabove, it gives a positive output when the output of the comparator 227 has increased in excess of the set voltage Vs or has increased in negative sens exceeding the set voltage −Vs.

The comparing circuit 280 is provided with a comparator-amplifier 281 having a non-inverse side input terminal to which the output of the comparator 216 is applied and an inverse side input terminal to which a set voltage Va is applied, and with a comparator-amplifier 282 having a non-inverse side input terminal to which a set voltage −Vs is applied and an inverse side input terminal to which the output of the comparator 216 is applied. The outputs of the comparator-amplifier 281 and 282 are transmitted to the driving circuit 300 of the electromagnetic valve 310 through rectifying diodes 283 and 284 respectively.

The comparing circuit 290 is provided with a comparator-amplifier 291 having a non-inverse side input terminal to which the output of the comparator 208 is applied and an inverse side input terminal to which a set voltage Vs is applied, and with a comparator-amplifier 292 having a noninverse side input terminal to which a set voltage −Vs is applied and an inverse side input terminal to which the output of the comparator 208 is applied. The outputs of the comparator-amplifiers 291 and 292 are transmitted to the driving circuit 300 through rectifying diodes 293 and 294 respectively.

The driving circuit 300 is provided with a phase inverting amplifier 301 having a non-inverse side input terminal to which a set voltage Vs is applied and an inverse side input terminal to which the outputs of the comparing circuits 270, 280 and 290 are applied. The outputs of the amplifier 301 in the driving circuit 300 is transmitted to a thyristor 303 through a switching transistor 302. An electromagnetic valve 310 for the throttle valve 73 is connected in series with the thyristor 303.

Now the operation of an electric circuit for driving the electromagnetic valve 310 will be described with reference to FIG. 9. For example, when there is a great difference between the relative positions of the bucket 6 of the power shovel 1 and the control bucket 106 of the control lever 100, the difference therebetween is detected by the comparator 227. When a differential voltage corresponding to the difference between the relative positions of the bucket and the control bucket detected by the comparator 227 exceeds a predetermined maximum or minimum value of the set voltage +Vs or −Vs, the comparing circuit 270 transmits a positive output. The output of the comparing circuit 270 is inverted in phase by the amplifier 301 and is applied to the transistor 302. Therefore, when a differential voltage corresponding to the difference between the relative positions of the bucket 6 and the control bucket 106 is out of the permissible limits predetermined by said set voltage +Vs or −Vs, the transistor 302 is not actuated. Thus since the tyristor 303 is also not actuated, the electromagnetic valve 310 remains in closed state and the fluid passage from the pump 71 to the hydraulic bucket actuator is bypassed to the throttle valve 73. Thus even if the electromagnetic valve 229 of the hydraulic bucket actuator 12 is in open state made by the output of the comparing circuit 227, the hydraulic bucket actuator 12 can operate but slowly.

Whereas, when the relative positions of the bucket 6 and the control bucket 106 become within the permissible limits, the transistor 302 and the thyristor 303 are actuated to open the electromagnetic valve 310, therefore, the pressure fluid is directly fed to the hydraulic bucket actuator 12 without passing the throttle valve 73, thus the hydraulic actuator 12 is normally driven.

As shown in FIG. 9, the thyristor 303 is connected to D.C. sources +B and −B. Therefore, when the thyristor 303 has been made on once, it remains in on-state until the current is interrupted and makes the electromagnetic valve 310 in open state.

The case where this is a great difference between the relative positions of the bucket 6 and the control bucket 106 has been described, however, the description is also applicable to cases where there is a great difference between the relative positions of the arm 5 and the control arm 105 and where there is a great difference between the relative positions of the boom 4 and the control boom.

In the powder shovel control system of the present invention, long leads are inevitably required to connect the potentiomers for detecting the turn anlges of the boom 4, the arm 5 and the bucket 6 of the power shovel, however, such long leads are not always desirable since consideration should be given to such events of that the leads are cut or short-circuited. In such events, the elements of the power shovel 1 are not controllable and there is a danger of a wild movement of the power shovel.

Therefore, the combined control level 100 of the present invention may be provided with a safety device for preventing such accident.

FIG. 10 is a diagram of the safety device embodied in the circuit shown in FIG. 3.

As shown in FIG. 10, the safety device is consisting of an abnormality detecting circuit 350, a comparator 360, a transistor $Tr_3$, and a reference potential VR. The abnormality detecting circuit 350 includes a transistor $Tr_0$ of which collector is grounded and of which emitter is connected to a lead of a potentiometer for detecting the turn angle of a movable element of the power shovel 1, for example, the lead $1_3$ of the potentiometer 217 for detecting the turn angle of the boom 4, and also connected to the non-inverse side input terminal of the comparator 360. The base of the transistor $Tr_0$ is connected to the lead $1_2$ for taking out a detected turn angle signal from the potentiometer 217 through a resistor $R_5$ and is grounded through a resistor $R_6$.

A positive reference potential VR is applied to the inverse side input terminal of the comparator 360. This reference potential VR functions to actuate the comparator 360 when the input voltage applied to the non-inverse side input terminal of the comparator 360 is of a value lower than predetermined value. The collectorare inverted whereby the transistors $Tr_4$ and $Tr_5$ are interrupted.

From the foregoing, it is clear that cross contacts taken place between the leads $1_1$, $1_2$ and $1_3$ may be detected by the comparators 371 and 372 whereby the driving current to the electromagnetic valve 210 may be interrupted.

Further as shown is FIG. 10, by connecting a relay 380 between the common emitter circuit of the transistors $Tr_1$ and $Tr_2$ and the positive power source +V, an alarm device or a fault indicating device may be actuated when breaking, grounding or a cross contact is taken place.

It is clear from the foregoing that according to the present invention, the elements of the combined control lever 100, i.e. the control boom 104, the control arm 105 and the control bucket 106 may be manipulated regardless of loads on the boom 4, the arm 5, and bucket 6 of the power shovel 1 during the work such as digging. It is understood, however, that if loads on the power shovel 1 are not transmitted to the control lever 100, not only the operator cannot feel the movement of the power shovel through his hands but also he is unable to know the actual attitudes of the elements of the power shovel 1, thus there is a fear of diminishing advantages of that the attitudes of the power shovel elements 4, 5 and 6 are controlled as the control elements 104, 105 and 106 of the control lever 100 are manipulated.

In operation of the power shovel, it is, therefore, preferred to apply the brake to each element of the power shovel according to the load applied thereto and to give a feeling corresponding to the load to the operator manipulating the control lever, whereby to let him know the loaded condition of the power shovel and the attitudes of the elements of the power shovel through the turn angles of the control elements of the control lever.

Thus, the power shovel control system of the present invention may be provided with a load transmitter which gives a feeling corresponding to the load on the power shovel to the operator manipulating the control lever whereby to let him know the actual operated and loaded condition of the powder shovel.

FIGS. 11 and 12 are diagrams showing such a load transmitter in the power shovel control system of the present invention. Referring to FIGS. 11 and 12, the load transmitter comprises an electromagnetic brake 130 for restricting the rotation of the pivot 107 of an element of the control lever 100, for example, the control boom 104, a tortional elastic coupling 132 for coupling the boom pivot 107 with the output shaft 131 of the electromagnetic brake 130, and an electric circuit 400 for controlling the electromagnetic brake 130.

As described in detail with reference to FIGS. 2 and 3, when the control boom 104 is manipulated, a differential voltage is generated between the potentiometer 207 for detecting the turn angle of the control boom 104 and the potentiometer 217 for detecting the turn angle of the boom 4, and the differential signal is detected by the comparator 208 to control the electromagnetic valve 212 of the hydraulic boom actuator 8.

At this point of time, when the boom 4 of the power shovel 1 can not follow the rapid movement of the control boom 104 of the control lever 100, or when the boom 4 can not easily move with the movement of the control boom 104 due to a heavy external load applied thereto, the value of the differential voltage generated between the potentiometers 207 and 217 will be greater than a given value. This differential voltage is taken out to actuate the electromagnetic brake 130 coupled to the pivot 107 of the control boom 104 through the torsional elastic coupling 132.

Whereby the load on boom 4 is transmitted to the control boom 104, thus the operator at the control boom can know the loaded condition of the boom 4 and can reduce any difference between the turn angle of the control boom 104 and the actual position of the boom 4 of the power shovel 1.

As shown in FIG. 12, in addition to the comparing circuit 208 for comparing the outputs of the potentiometers 207 and 217, a load transmitting comparator circuit 400 is provided. The electric circuit 400 comprises comparators 401 and 402. The output voltage of the potentiometer 207 is applied to the non-inverse side input terminal of the comparator 401 and to the inverse side input terminal of the comparator 402, while the output voltage of the potentiometer 217 is fed to the inverse side input terminal of the comparator 401 and to the non-inverse side input terminal of the comparator 402. The output of the load transmitting comparator circuit 400 is applied to the electromagnetic brake 130.

Each of the comparators $208_a$, $208_b$ in the comparing circuit 208 and the comparators 401 and 402 in the load transmitting comparator circuit 400 is preferably given with a hysterisis characteristic by a positive feedback loop so that the electromagnetic value 210 and the electromagnetic brake 130 do not chatter, i.e. their unnecessary frequent off-on actions may be avoided during the actuation of the boom 4, and with a threshold level variable function by a variable voltage source so that the value of the differential voltage between the potentiometers 207 and 217 may be regulated during the play width of the control boom 104 and the electromagnetic brake 130 are locked.

In the load transmitter, the pivot 107 of the control boom 104 and the output shaft 131 of the electromagnetic brake 130 are coupled by the coupling 132 having a torsional elasticity.

The coupling 132 having a torsional elasticity is particularly required for the following reason:

For example, when the boom 4 is not able to follow the manipulation speed of the control boom 104, since the differential voltage between the potentiometers 207 and 217 is reduced as the boom 4 is moved, whereby the locking of the electromagnetic brake is released, such a torsional elasticity of the coupling 132 is not required.

If the coupling 132 has not a torsional elasticity, however, the electromagnetic brake 130 will be locked when the boom 4 is not further movable from a certain position with the manipulation of the control boom 104. Since the boom 4 does not follow the movement of the control boom 104, once the electromagnetic brake 130 has been locked, the operator feels an excess load and the control boom 104 is not replaceable even so intended.

Whereas, in the case where the coupling 132 having a torsional elasticity is used, when the operator feels an excess load on the boom 4 through the control boom 104 and he intends to replace the control boom, it can be replaced to a certain degree due to the torsional elasticity of the coupling 132. Consequently the differential voltage between the potentiometers 207 and 217 is reduced and the locking of the electromagnetic brake 130 is released. Besides, by using the coupling 132 having a torsional elesticity, the shock of the control boom 104 may be dumped when the electromagnetic brake 130 is locked and a resistant feeling corresponding to the difference between the turn angles of the boom 4 and the control boom 104 may be transmitted to the operator.

In the foregoing, the load transmitter for transmitting a load to the control lever 100 during the operation of the power shovel 1 has been described as a device which is actuated when the difference between the turn angles of the power shovel 1 and the control lever 100 exceeds a predetermined value and which includes the electromagnetic brake 130 and the coupling 132 having a torsional elesticity. It is understood, however, various modifications, thereof may be provided by applying the described principle thereto. For example, in a modification, the electromagnetic brake 130 may be replaced by a torque generator and the coupling 132 having a torsional elasticity may be in the form of a clutch mechanism which provides a reaction force corresponding to the difference between the turn angles of the power shovel 1 and the control lever 100, in a direction opposite to the manipulating direction of the control lever 100.

As described with reference to FIGS. 1–3, according to the present invention, when the elements of the control lever 100, i.e. the control boom 104, the control arm 105 and the control bucket 106 are manipulated by the operator, the elements of the power shovel 1, i.e. the boom 4, the arm 5 and the bucket 6 may be moved with the manipulation of the elements of the control lever 100.

There are many types of the works which can be accomplished by using a power shovel and even in the same work, the control pattern of the power shovel varies according to the nature of the ground to be dug and to other working conditions. However, in a digging work, for example, the greater part of the work is usually accomplished by repeating the same control pattern.

FIG. 13 shows a typical control pattern in such a case, in which the bucket 6 is moved from position A to positions B. C and D successively. Upon our researches on the movements of the power shovel elements 4, 5 and 6, as shown in FIG. 14, for example, usually the boom 4 is turned through 80 degrees in maximum, the arm 5 is turned through 110 degrees and the bucket 6 is turned through 120 degrees in maximum.

FIG. 15 is a diagram showing the loci of the movements of the boom 4, the arm 5 and the bucket 6 in the typical control pattern during work with the power shovel. In FIG. 15, curves X, Y and Z respectively show the loci of the movements of the boom 4, the arm 5 and the bucket 6. In the initial highest position A of the bucket 6, all angles of the other elements are zero, then the angle of the boom 4 is increased to lower the bucket 6. When the boom 4 is raised to its highest position of about 80°, the arm 5 is started to turn, and when the arm 5 is turned through about 30°–40°, the bucket 6 is turned until it reaches its position C. In the position C of the bucket 6, the arm 5 and the bucket 6 are started to turn simultaneously. The arm 5 is first turned through the maximum angle of 110°, then the bucket 6 is turned through the maximum angle of 120°. Thereafter, the boom 4 is started to return so as to gradually reduce its angle and when the angle has been reduced to zero, the boom 4 reaches its position D.

In order to dump mud in the bucket to a suitable place on the side of the ditch or trench, for example, onto a dump truck, the whole power shovel 1 must be turned to the left or right. After the turning period E, i.e. in the turned state of the whole power shovel 1, the arm 5 and the bucket 6 are returned to their highest position A whereby to dump the mud in the bucket 6. Then the whole power shovel 1 is returned to the digging position. After this returning period F, the pattern of the digging work is repeated.

If the angle setting signals to be applied to the power shovel elements from the elements of the control level 100 are set to a predetermined control pattern, the power shovel may be controlled without manipulating the control lever.

According to the present invention, in a power shovel control system as described hereinabove, means for programming a predetermined control pattern whereby generating boom, and bucket pragram signals and transmitting the program signals to the control circuit 200 of the hydraulic actuators of the power shovel elements, may be provided.

FIG. 16 is a diagram of the circuit shown in FIG. 2 into which a second reference signal generator is incorporated. In FIG. 16, interlocking change-over switches 450 function to switch the potentiometers 207, 215 and 226 of the reference signal generator for actuating the boom, the arm and the bucket to potentiometers 501, 502 and 503 of the programmed second reference signal generator 500.

FIG. 17 shows a schematic perspective view of an example of the program signal generator 500 of the present invention. In the program signal generator 500, a boom cam 514, an arm cam 515 and a bucket cam 516 are respectively attached to shafts 511, 512 and 513 journalled in a base plate 510 of the program signal generator 500. The shafts 511, 512 and 513 are respectively provided with gears 517, 518 and 519 which are so arranged as to be rotated through play gears 520, 521 and 522 by a gear 525 attached to an output shaft 524 of a motor 523 in the same rotating direction and at the same speed of the output shaft 524.

The profile of the boom cam 514 is such that its one revolution generates the locus of curve X shown in FIG. 15, the profile of the arm cam 515 is such that its one revolution generates the locus of curve Y shown in FIG. 15 and the profile of the bucket cam 516 is such that its one revolution generates the locus of curve Z shown in FIG. 15.

The output shaft 524 of the motor 523 is coupled to the motor 523 through an elastromagnetic clutch 540 which is arranged so that it interrupts the connection between the motor 523 and its output shaft 524 as a microswitch is actuated.

The output shaft 524 is provided with a cam plate 542 at its upper end. The cam plate 542 is provided with two lobes 544 and 545. These lobes function to provide the turn periods E and F shown in FIG. 15 and to actuate the microswitch 541 to interrupt the connection between the motor 523 and the output shaft 524 through the electromagnetic clutch 540.

The boom cam 514 cooperates with a rack 526 which is provided with a coiled spring assembly 529 at one end and of which other end is pressed against the cam surface of the boom cam 514 so as to follow its movement. In the same manner, the arm cam 515 and the bucket cam 516 respectively cooperate with racks 527 and 528 which are respectively provided with coiled spring assemblies 530 and 531 at one end and of which other end are respectively pressed against the cam surface of the cams 515 and 516.

The boom rack 526 is engaged with a pinion 532 attached to the rotary shaft of the boom program signal generating potentiometer 501. Similarly, the arm rack 527 is engaged with a pinion 533 attached to the rotary shaft of the arm program signal generating potentiometer 502 and the bucket rack 528 is engaged with a pinion 534 attached to the rotary shaft of the bucket second reference signal generating potentiometer 503 respectively.

In this embodiment, since when the change-over switch 450 switches the angle setting circuit of the manual control to the program signal generator 500 programmed according to such a diagram as shown in FIG. 15, and the boom cam 514 is rotated with the rotation of the motor 523 to rotate the pinion 532 engaged with the rack 526, the potentiometer 501 transmits a boom program signal corresponding to the configuration of the boom cam 514 to the comparator 208 whereby to control the driving circuit 209 of the hydraulic boom actuator 8 so as to actuate the boom 4 to generate the locus of curve X shown in FIG. 15. In the same manner, the arm 5 is actuated so as to generate the locus of curve Y and the bucket 6 is actuated so as to generate the locus of curve Z.

Since the rotating cams 514, 515 and 516 are stopped when the microswitch 541 is actuated by the lobe 544 of the cam 542 which cooperates with the microswitch 541, at this time operator can swing the power shovel 1 in a suitable direction, for example, the direction in which the bucket 6 is positioned over a dump truck. Thereupon, when the electromagnetic clutch 540 is reactuated to transmit the rotation of the motor 523 to the output shat 524, the cams 514, 515 and 516 are further rotated to actuate the elements of the power shovel successively whereby the mud in the bucket 6 is dumped. Then when the lobe 545 of the cam 542 engages with the microswitch 541 to actuate the electromagnetic clutch 550 so as to discontinue the transmission of the rotation of the motor 523 to the output shaft 524, the rotation of the cams 514, 515 and 516 is ceased. At this time, the operator can swing the power shovel 1 to return it to the digging work position.

As shown in FIG. 18, all of the boom cam 514, the arm cam 515 and the bucket can 516 may be mounted on the output shaft 524 which is coupled to the motor 523 by the electromagnetic clutch 540.

The program signal generator may be provided by analysing the motion patterns of the power shovel elements according to the type of the work such as shown in FIG. 15. The reference signal generators have been described herein as the generators provided with potentiometers, however, other means such as electro-optical means may be used in place of the reference signal generators.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A system for controlling a power shovel consisting of an upper swivel turret section, a lower chassis section, a boom attached to said upper swivel turret section so as to be vertically turned by a first hydraulic actuator, an arm attached to one end of said boom so as to be turned by a second hydraulic actuator, a bucket attached to one end of said arm so as to turned by a third hydraulic actuator, a fourth hydraulic actuator for turning horizontally said upper swivel turret section, piping for feeding hydraulic fluid to said hydraulic actuators, and flow rate limiters provided in the piping so that said hydraulic actuators can be actuated for a given period of time from their starting time, said control system comprising:

A. a manual control lever consisting of a control boom, a control arm and a control bucket which are miniatures of said boom, arm and bucket of the power shovel, said manual control lever being capable of turning horizontally with respect to a base by hand and of taking up a neutral position in free, .

B. means for generating a detected boom angle signal proportional to the turn angle of said boom, C. means for generating a detected arm angle signal proportional to the turn angle of said arm, D. means for generating a detected bucket angle signal proportional to the turn angle of said bucket, E. means for generating a boom angle setting signal proportional to the turn angle of the control boom of said control lever, F. means for generating an arm angle setting signal proportional to the turn angle of the control arm of said control lever, G. means for generating a bucket angle setting signal proportional to the turn angle of the control bucket of said control lever, H. a circuit for communicating said detected boom, arm and bucket angle signal generators with said control boom, arm and bucket reference signal generators, said circuit including:

i. a first comparator for comparing said detected boom angle signal with said boom reference signal and for generating a differential signal therebetween, ii. a second comparator for comparing said detected arm angle signal with said arm reference signal and for generating a differential signal therebetween, iii. a third comparator for comparing said detected bucket angle signal with said bucket reference signal and generating a differential signal therebetween, iv. a circuit for transmitting a control signal to said first hydraulic actuator according to the differential signal received from said first comparator, v. a circuit for transmitting a control signal to said second hydraulic actuator according to the differential signal received from said second comparator, and vi. a circuit for transmitting a control signal to said third hydraulic actuator according to the differential signal received from said third comparator; and I. means for applying a control signal to said fourth hydraulic actuator for turning said upper swivel turret section to the left or right when said combined control lever is manually turned to the left or right.

2. A power shovel control system as claimed in claim 1, wherein said detected boom, arm and bucket angle signal generators are potentiometers which respectively cooperate with the pivots of said boom, arm and bucket.

3. A power shovel control system as claimed in claim 2, wherein said detected bucket angle signal generator is disposed in a position remote from the pivot of said bucket.

4. A power shovel control system as claimed in claim 1, wherein a circuit for communicating said detected boom, arm and bucket angle generators respectively with the angle setting signal generators of said control lever is interrupted through the switches provided in the operator's seat.

5. A power shovel control system as claimed in claim 1, wherein said flow rate limiters are controlled by the differential signals received from said comparators.

6. A power shovel control system as claimed in claim 1, wherein said system includes means for generating a boom program signal programmed so as to follow the locus of the predetermined movement of said boom, means for generating an arm program signal programmed so as to follow the locus of the predetermined movement of said arm, means for generating a bucket pragram signal programmed so as to follow the locus of the predetermined movement of said bucket, and changeover switches for applying the output signals of said boom, arm and bucket program signal generating means respectively to said corresponding comparators instead of said boom, arm and bucket angle setting signals.

7. A system for controlling a power shovel consisting of an upper swivel turret section, a lower chassis section, a boom attached to said upper swivel turret section so as to be vertically turned by a first hydraulic actuator, an arm attached to one end of said boom so as to be turned by a second hydraulic actuator, a bucket attached to one end of said arm so as to be turned by a third hydraulic actuator, said upper swivel turret section being turned horizontally by means of a fourth hydraulic actuator, said control system comprising:

A. a manual control lever consisting of a control boom, a control arm and a control bucket which are miniatures of said boom, arm and bucket of the power shovel, said manual control lever being capable of turning horizontally with respect to a base by hand and of taking up a neutral position in free, B. means for generating a detected boom angle signal proportional to the turn angle of said boom, C. means for generating a detected arm angle signal proportional to the turn angle of said arm, D. means for generating a detected bucket angle signal proportional to the turn angle of said bucket, E. means for generating a boom angle setting signal proportional to the turn angle of the control boom of said control lever, F. means for generating an arm angle setting signal proportional to the turn angle of the control arm of said control lever, G. means for generating a bucket angle setting proportional to the turn angle of the control bucket of said control lever, H. a circuit for communicating said detected boom, arm and bucket angle signal generators with said control boom, arm and bucket reference signal generators, said circuit including:

i. a first comparator for comparing said detected boom angle signal with said boom reference signal and for generating a differential signal therebetween, ii. a second comparator for comparing said detected arm angle signal with said arm reference signal and for generating a differential signal therebetween, iii. a third comparator for comparing said detected bucket angle signal with said bucket reference signal and generating a differential signal therebetween, iv. a circuit for transmitting a control signal to said first hydraulic actuator according to the differential signal received from said first comparator, v. a circuit for transmitting a control signal to said second hydraulic actuator according to the differential signal received from said second comparator, and vi. a circuit for transmitting a control signal to said third hydraulic actuator according to the differential signal received from said third comparator;

I. means for applying a control signal to said fourth hydraulic actuator for turning said upper swivel turret section to the left or right when said combined control lever is manually turned to the left or right, and J. an abnormality detecting circuit for detecting variations in the output potentials of said detected boom, arm and bucket angle signal generators, comparators for respectively transmitting outputs when the outputs of said detected boom, arm and bucket angle signal generators have varied in excess of given values respectively, and a circuit for stopping the actuation of said hydraulic actuators in response to the outputs of said comparators.

8. A power shovel control system as claimed in claim 7, wherein said detected boom, arm and bucket angle signal generators are potentiometers which respectively cooperate with the pivots of said boom, arm and bucket.

9. A power shovel control system as claimed in claim 8, wherein said detected bucket angle signal generator is disposed in a position remote from the pivot of said bucket.

10. A power shovel control system as claimed in claim 7, wherein a circuit for communicating said detected boom, arm and bucket angle generators respectively with the angle setting signal generators of said control lever is interrupted through the switches provided in the operator's seat.

11. A power shovel control system as claimed in claim 7, wherein said system includes means for generating a boom program signal programmed so as to follow the locus of the predetermined movement of said boom, means for generating an arm program signal programmed so as to follow the locus of the predetermined movement of said arm, means for generating a bucket program signal programmed so as to follow the locus of the predetermined movement of said bucket, and change-over switches for applying the output signals of said boom, arm and bucket program signal generating means respectively to said corresponding comparators instead of said boom, and bucket angle setting signals.

12. A system for controlling a power shovel consisting of an upper swivel turret section, a lower chassis section, a boom attached to said upper swivel turret section so as to be vertically turned by a first hydraulic actuator, an arm attached to one end of said boom so as to be turned by a second hydraulic actuator, a bucket attached to one end of said arm so as to be turned by a third hydraulic actuator, said upper swivel turret section being turned horizontally by means of a fourth hydraulic actuator, said control system comprising:

A. a manual control lever consisting of a control boom, a control arm and a control bucket which are miniatures of said boom, arm and bucket of the power shovel, said manual control lever bring capable of turning horizontally with respect to a base by hand and of taking up a neutral position in free, B. means for generating a detected boom angle signal proportional to the turn angle of said boom, C. means for generating a detected arm angle signal proportional to the turn angle of said arm, D. means for generating a detected bucket angle signal proportional to the turn angle of said bucket, E. means for generating a boom angle setting signal proportional to the turn angle of the control boom of said control lever, F. means for generating an arm angle signal proportional to the turn angle of the control arm of said control lever, G. means for generating a bucket angle setting signal proportional to the turn angle of the control bucket of said control lever, H. a circuit for communicating said detected boom, arm and bucket angle signal generators with said control boom, arm and bucket reference signal generators, said circuit including:

i. a first comparator for comparing said detected boom angle signal with said boom reference signal and for generating a differential signal therebetween, ii. a second comparator for comparing said detected arm angle signal with said reference signal and for generating a differential signal therebetween, iii. a third comparator for comparing said detected bucket angle signal with said bucket reference signal and generating a differential signal therebetween, iv. a circuit for transmitting a control signal to said first hydraulic actuator according to the differential signal received from said first comparator, v. a circuit for transmitting a control signal to said second hydraulic actuator according to the differential signal received from said second comparator, and vi. a circuit for transmitting a control signal to said third hydraulic actuator according to the differential signal received from said third comparator;

I. means for applying a control signal to said fourth hydraulic actuator for turning said upper swivel turret section to the left or right when said combined control lever is manually turned to the left or right, J. electric damping means respectively coupled to the pivots of the control elements of said control lever through couplers, and K. means for actuating said electric damping means when the differential voltages between the reference signals from the control elements of said control lever and the detected angle signals of the elements of said power shovel have exceeded given values respectively.

13. A power shovel control system as claimed in claim 12, wherein said couplers are the couplings having a torsional elasticity.

14. A power shovel control system as claimed in claim 12, wherein said electric damping means are torque generators and said couplers are clutch mechanisms.

15. A power shovel control system as claimed in claim 12, wherein said detected boom, arm and bucket angle signal generators are potentiometers which respectively cooperate with the pivots of said boom, arm and bucket.

16. A power shovel control system as claimed in claim 15, wherein said detected bucket angle signal generator is disposed in a position remote from the pivot of said bucket.

17. A power shovel control system as claimed in claim 12, wherein a circuit for communicating said detected boom, arm and bucket angle generators respectively with the angle setting signal generators of said control lever is interrupted through the switches provided in the operator's seat.

18. A power shovel control system as claimed in claim 12, wherein said system includes means for generating a boom program signal programmed so as to follow the locus of the predetermined movement of said boom, means for generating an arm program signal programmed so as to follow the locus of the predetermined movement of said arm, means for generating a bucket program signal programmed so as to follow the locus of the predetermined movement of said bucket, and change-over switches for applying the output signals of said boom, arm and bucket program signal generating means respectively to said corresponding comparators instead of said boom, arm and bucket angle setting signals.

* * * * *